US011668167B2

(12) United States Patent
Romer et al.

(10) Patent No.: US 11,668,167 B2
(45) Date of Patent: Jun. 6, 2023

(54) PROTECTING GAS LIFT VALVES FROM EROSION

(71) Applicant: ExxonMobil Technology and Engineering Company, Spring, TX (US)

(72) Inventors: Michael C. Romer, The Woodlands, TX (US); Rosmer Maria Brito Jurado, Spring, TX (US); Tony W. Hord, Spring, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 730 days.

(21) Appl. No.: 16/582,226

(22) Filed: Sep. 25, 2019

(65) Prior Publication Data

US 2020/0182027 A1 Jun. 11, 2020

Related U.S. Application Data

(60) Provisional application No. 62/776,723, filed on Dec. 7, 2018.

(51) Int. Cl.
*E21B 43/12* (2006.01)
*E21B 34/08* (2006.01)

(52) U.S. Cl.
CPC ..... *E21B 43/123* (2013.01); *E21B 34/08* (2013.01)

(58) Field of Classification Search
CPC ..... E21B 43/123; E21B 34/08
See application file for complete search history.

(56) References Cited

U.S. PATENT DOCUMENTS

| | | | | |
|---|---|---|---|---|
| 6,328,102 | B1 | 12/2001 | Dean | |
| 7,111,675 | B2 | 9/2006 | Zisk, Jr. | |
| 7,322,803 | B2 | 1/2008 | Vogeley | |
| 7,484,940 | B2 | 2/2009 | O'Niell | |
| 7,597,150 | B2 | 10/2009 | Clem | |
| 8,133,041 | B2 | 3/2012 | Ludlow et al. | |
| 8,220,533 | B2 | 7/2012 | Longfield et al. | |
| 8,511,390 | B2 | 8/2013 | Coyle et al. | |
| 2002/0197174 | A1 | 12/2002 | Howard | |
| 2003/0010491 | A1 | 1/2003 | Collette | |
| 2006/0198742 | A1 | 9/2006 | DiFoggio et al. | |
| 2008/0080991 | A1 | 4/2008 | Yuratich et al. | |
| 2009/0183879 | A1 | 7/2009 | Cox | |
| 2009/0218091 | A1 | 9/2009 | Dotson | |
| 2010/0012313 | A1 | 1/2010 | Longfield | |
| 2012/0145397 | A1* | 6/2012 | Schultz | F24T 10/20 166/57 |
| 2012/0023606 | A1 | 10/2012 | Bouldin et al. | |
| 2020/0347698 | A1* | 11/2020 | Ejim | E21B 43/128 |

FOREIGN PATENT DOCUMENTS

| | | |
|---|---|---|
| GB | 2 393 747 A | 4/2004 |
| GB | 2 403 752 A | 1/2005 |
| WO | WO 01/20126 A2 | 3/2001 |

* cited by examiner

*Primary Examiner* — P. Macade Nichols
(74) *Attorney, Agent, or Firm* — ExxonMobil Technology and Engineering Company—Law Department

(57) ABSTRACT

Systems and a method are provided for protecting a gas lift valve (GLV) from erosion. An example system includes a gas lift valve that includes an unloading protection orifice, and wherein the unloading protection orifice unloading protection orifice includes a different open area than a valve seat in the gas lift valve.

19 Claims, 11 Drawing Sheets

200

400

500

102

102

102

102

1100

PROTECTING GAS LIFT VALVES FROM EROSION

CROSS-REFERENCE TO RELATED APPLICATION

This application claims the benefit of U.S. Provisional Application 62/776,723 filed Dec. 7, 2018 entitled "Protecting Gas Lift Valves from Erosion," the entirety of which is incorporated by reference herein.

FIELD

The techniques described herein relate to well completions used for removing liquid from the annulus of well. More particularly, the techniques relate to gas lift valves that have inherent protection from erosion during the unloading of liquids.

BACKGROUND

This section is intended to introduce various aspects of the art, which may be associated with example examples of the present techniques. This discussion is believed to assist in providing a framework to facilitate a better understanding of particular aspects of the present techniques. Accordingly, it should be understood that this section should be read in this light, and not necessarily as admissions of prior art.

During the drilling of a well, larger diameter wellbores are cased leading to narrow diameter wellbores which are also cased, finally leading to the production zones in the reservoir. As each section is cased, concrete is injected around the casing to hold it in place. The well is then completed by operations to begin the production of hydrocarbons from the reservoir. The completions include the formation of perforations through the casing and concrete of the final section into the reservoir using a perforation gun. Production tubing is then inserted down the wellbore into the production zone. The production tubing may include gas lift valves to enable the use of artificial lift to remove liquids from the well.

However, unloading of fluids from the wellbore through the gas lift valves (GLVs) may damage the GLVs. This may occur as a result of reverse-flow through a check valve, stem and seat erosion from the completion liquids, or both.

SUMMARY

An embodiment described herein provides a well completion that includes a gas lift valve. The gas lift valve includes an unloading protection orifice that includes a smaller open area than a valve seat in the gas lift valve.

Another embodiment described herein provides a gas lift valve that includes an unloading protection orifice, and wherein the unloading protection orifice unloading protection orifice includes a smaller open area than a valve seat in the gas lift valve.

Another embodiment described herein provides a method for protecting a gas lift valve (GLV) from erosion. The method includes calculating an area for an unloading protection orifice, wherein the area is based, at least in part, on a depth of the in a well. The unloading protection orifice is machined into an orifice plate using the calculated area. The unloading protection orifice is mounted in an opening between the GLV and an annulus of the well. The GLV is installed into a production tubing string as the production tubing string is installed in the well.

DESCRIPTION OF THE DRAWINGS

The foregoing and other advantages of the present techniques may become apparent upon reviewing the following detailed description and drawings of non-limiting examples of examples in which.

Figure 1:
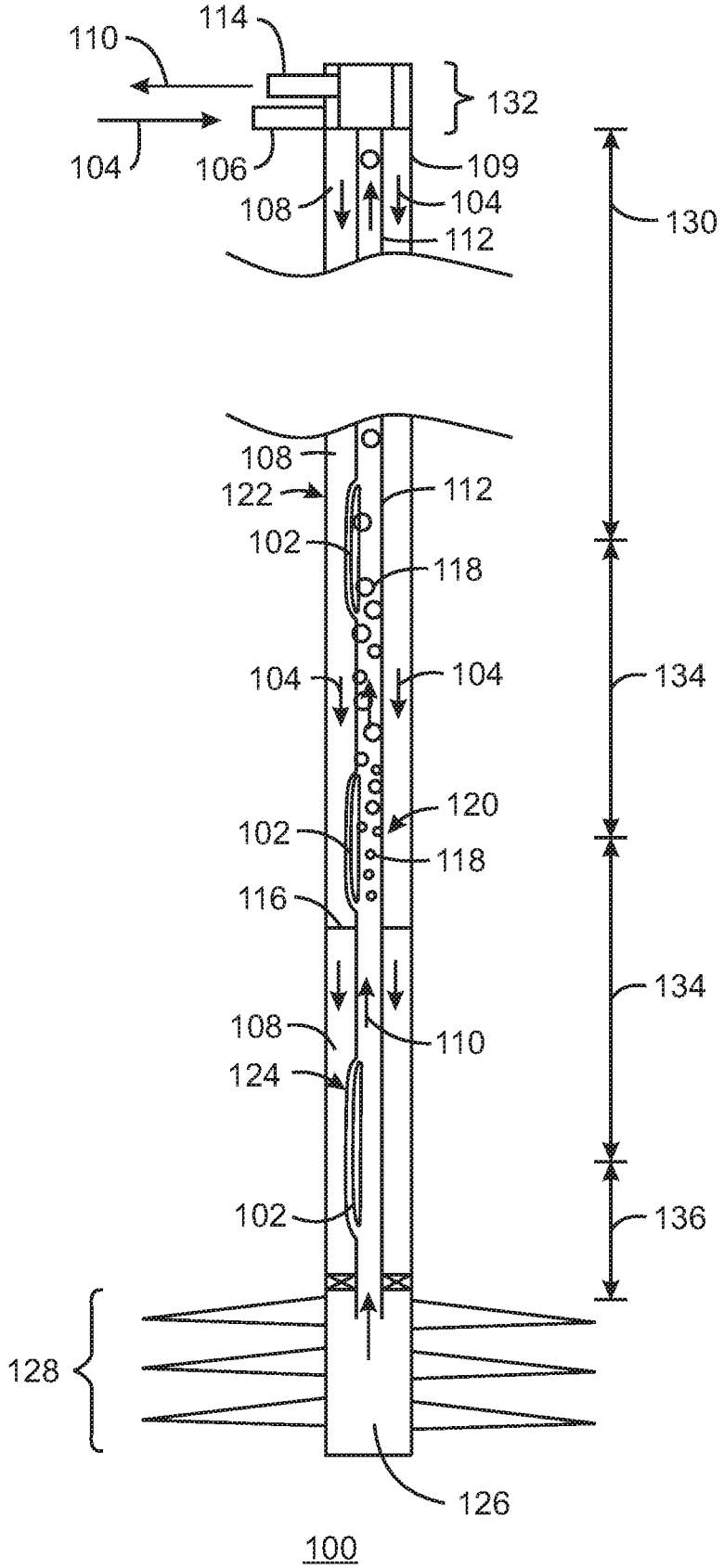
FIG. 1 is a schematic drawing of the unloading of liquid from a well using gas lift valves (GLVs), in accordance with examples.

It should be noted that the figures are merely example of several examples of the present techniques and no limitations on the scope of the present techniques are intended thereby. Further, the figures are generally not drawn to scale, but are drafted for purposes of convenience and clarity in illustrating various aspects of the techniques.

DETAILED DESCRIPTION

In the following detailed description section, the specific examples of the present techniques are described in connection with preferred examples. However, to the extent that the following description is specific to a particular embodiment or a particular use of the present techniques, this is intended to be for example purposes only and simply provides a description of the example examples. Accordingly, the techniques are not limited to the specific examples described below, but rather, it includes all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

A "drill string" is understood to include a collection or assembly of joined tubular members, such as casing, tubing, jointed drill pipe, metal coiled tubing, composite coiled tubing, drill collars, subs and other drill or tool members, extending between the surface and on the lower end of the work string, is connected to the drill bit that forms the wellbore. A drill string may be used for drilling and be a drill string or an installation means. It should be appreciated that the work or drill string may be made of steel, a steel alloy, a composite, fiberglass, or other suitable material.

A gas lift production system is a type of artificial lift system used to remove completion fluids from a well or increase the performance of the well. The gas lift production system generally includes a valve system for controlling the injection of pressurized gas from a source external to the well, such as a compressor, into the borehole. The increased pressure from the injected gas forces accumulated formation fluid up the tubing to remove the fluids as production flow or to clear the fluids and restore the free flow of gas from the formation into the well.

A "gas lift valve" is a valve used in a gas lift system to control the flow of lift gas into the production tubing conduit. The gas-lift valve is located in a gas lift mandrel, which also provides communication with the lift gas supply in the tubing annulus. Operation of the gas lift valve is determined by preset opening and closing pressures in the tubing or annulus, depending on the specific application.

A "sidepocket" mandrel is an offset heavy-wall sub in the tubing for placing gas lift valves, temperature and pressure probes, injection line valves, and the like.

A "well" or "wellbore" refers to holes drilled vertically, at least in part, and may also refer to holes drilled with deviated, highly deviated, and/or horizontal sections of the wellbore. The term also includes wellhead equipment, surface casing, intermediate casing, and the like, typically associated with oil and gas wells.

As used herein, a "well completion" is a group of equipment and operations that may be installed and performed to produce hydrocarbons from a subsurface reservoir. The well completion may include the casing, production tubing, completion fluid, gas lift valves, and other equipment used to prepare the well and produce hydrocarbons.

Overview

Before start-up, a wellbore is usually filled with completion liquid, in the annulus and production tubing, to provide a pressure cap on any fluids coming up from the reservoir. Once the production tubing is in place, the completion liquid may be removed, for example, to be replaced with a gas used for gas lift assist.

Initially all of the gas lift valves (GLVs) are open due to the hydrostatic pressure of the completion liquid, which compresses the bellows, or springs, in the unloading valves. As the gas is injected into the annulus, the casing pressure pushes the liquid through the shallowest GLV. The annular liquid level then reaches the first GLV and continues to the second GLV. As the second GLV is uncovered, the casing pressure drops causing the first GLV to close. As each succeeding GLV is uncovered, the dip in casing pressure causes the last GLV to close. This continues until the gas reaches the final, or operating valve.

The flow of the liquid through the gas lift valves may cause failures due to reverse-flow, or stem and seat erosion during unloading. To lower the chance of creating these failures, it is generally recommended that the liquid flow rate is kept below about one barrel per minute. However, the unloading rate cannot be measured directly and it is normally not possible to calculate this rate. Pressure data is available, but that is for the tubing and casing at the surface. Further, downhole pressure gauges are typically isolated from the annulus.

The standard technique discussed in American petroleum Institute (API) RP 11 V5 GL provides guidance on ramping of the casing pressure to limit liquid rates through the GLVs during unloading. However, these procedures are not always followed in practice. Further, execution of the API procedure can be challenging, particularly for wells designed to use high flow rates of gas, and surface valving and controls may not be precise enough to implement the measurements. The high cost, high precision surface equipment that may be needed to perform the measurements may be difficult to economically justify, as it may only be used to unload a gas lift well a few times during the operational life.

The use of GLV's having eroded stems and seats will reduce the completion effectiveness and may limit optimization of the gas lift operation. Further, a nonfunctional reverse-flow check valve can be a well integrity issue. This will most likely trigger a work over in offshore environments, contributing to higher costs. Further, replacing GLV's can be difficult, particularly in high-angle wells. After a GLV is pulled, there is also the risk of communication of gases and liquids between the production tubing and the annulus. In examples described herein, an inlet orifice coupling the GLV to the annulus is provided to protect the components of the GLV from erosion due to high flow of liquids. The inlet orifice is designed to allow gases to continue to flow at high rates.

FIG. 1 is a schematic drawing of the unloading of liquid from a well 100 using gas lift valves (GLVs) 102, in accordance with examples. The unloading is performed by injecting a gas 104 into a coupling 106 that leads to an outer annulus 108 of the well 100, for example, formed between the well casing 109 and the production tubing 112. As the gas 104 is forced down the outer annulus 108, the liquid 110, such as a completion fluid, is forced through the GLVs 102, and up the production tubing 112. A production line 114 is coupled to the production tubing 112, and is used to remove the liquid 110.

As the liquid level 116 crosses a GLV, the gas 104 enters the production tubing 112 through the GLV 102. The gas 104 creates bubbles 118 that are entrained in the liquid 110, which lower the density of the liquid 110, allowing the pressure of the gas 104 to push the liquid to the surface. As the liquid level 116 crosses a particular GLV, for example, the mid-level GLV 120, the pressure drop from the gas 104 entering the production tubing 112 through the particular GLV 120 causes a next higher GLV, for example, the highest GLV 122 in the well 100, to close. When the liquid level 116 reaches the lowest GLV 102, for example, the operating valve 124 in the well 100, the pressure drop causes the next higher GLV, such as the mid-level GLV 120, to close, leaving only the operating valve 124 open. Gas 104 entering through the operating valve 124 may then assist in the production of hydrocarbon fluids 126 from a reservoir 128. In various examples, the pressure of the reservoir 128 is sufficient to produce hydrocarbon fluids 126 without further introduction of the gas 104.

The separation between the GLVs 102, or depth in more vertical sections, is determined by the pressure of the available gas 104, and the pressure head from the liquid 110 above each of the GLVs 102. In various examples, the separation 130 between the wellhead 132 and the highest GLV 122, in this example, is about 600 m (about 2000 feet). This separation 130 controls the rate of inflow of the liquid 110 into the production tubing 112. As described herein, the rate of inflow of the liquid 110 may be limited to less than about one barrel per minute. The separation 134 between each of the succeeding GLVs 102 may be about 75 m (about 250 feet) to about 300 m (about 1000 feet). The separation 134 between the GLVs 102 may be smaller towards the bottom of the well 100. The separation 136 between the operating valve 124 and the reservoir 128 may be determined by the pressure of the reservoir 128. A higher separation 136 between the operating valve 124 and the reservoir 128 may be used for a higher pressure in the reservoir 128.

In horizontal sections of a well 100, the separation 134 between the GLVs 102, which is determined by the pressure differential between the GLVs 102 in the well 100, may be larger. In these examples, the GLV 102 in a horizontal section may be more susceptible to erosion, as the amount of liquid 110 passing through the GLV 102, and the rate of flow of that liquid, may be higher than in GLVs 102 in more vertical sections.

As described herein, protecting the GLVs 102 from erosion due to the flow of liquid 110 through the GLVs 102 may be performed by controlling the separation 130 and 134 between the GLVs 102 or the pressure introduced into the outer annulus 108. However, controlling the flow rate may be difficult since measuring the parameters, such as pressure flow rate, may be difficult at the GLVs 102. Incorporation of a nozzle or orifice choke in the design of a GLV 102 may provide protection to the GLV 102 during unloading, or other operations in which liquids are flowing through the GLV 102. As described further with respect to FIG. 2, this may be performed by taking advantage of the increased pressure drop through the orifice for a liquid flow versus a gas flow.

Figure 2:
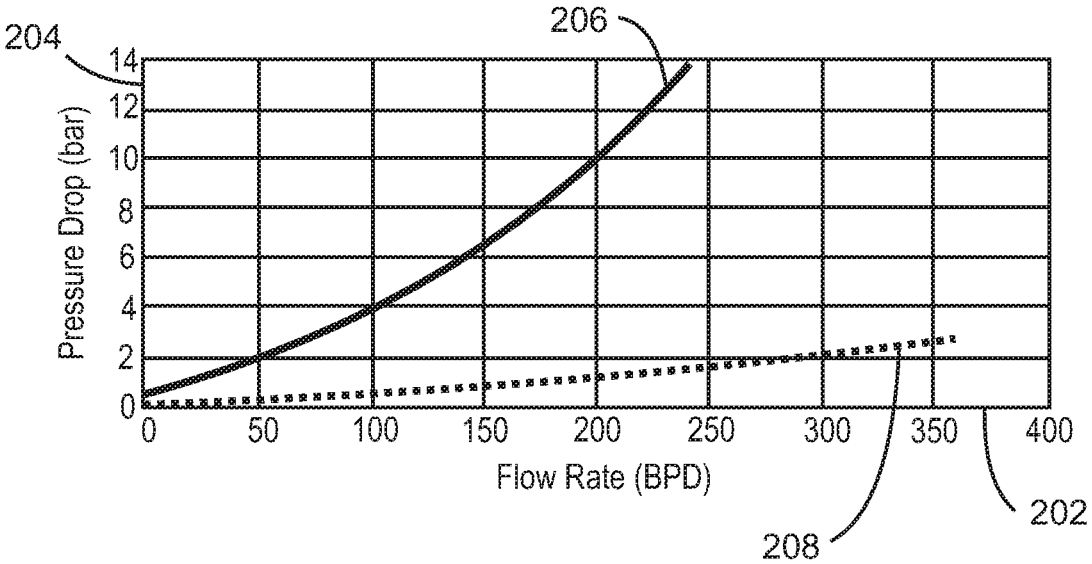
FIG. 2 is a plot of flow rate versus pressure drop for an injected gas versus a liquid across an orifice, in accordance with examples.

FIG. 2 is a plot 200 of flow rate 202 versus pressure drop 204 for an injected gas 208 versus a liquid 206 across an orifice, in accordance with examples. The flow across orifices is generally described by the Bernoulli equation, shown in equation 1 for incompressible media.

$$Q = A\sqrt{\frac{2P}{\rho}}. \quad \text{Eqn. 1}$$

In equation 1, Q is the flow rate, A is the nozzle area, P is the pressure drop, and p is the fluid density.

An internal orifice is already included in a GLV for the injection seat. The Bernoulli principle is also used to enable inflow control devices, or ICDs. If reservoir fluids increase in density, for example, water breaks into an oil zone, the flow rate through the associated ICD would decrease, allowing the overall oil cut from the cumulative zones to be maintained for a longer period. However, if a lower density fluid such as gas enters, it can pass through at a higher rate.

In in various examples, a passive orifice is placed in the GLV or GL mandrel at or upstream of the injected GL gas entry point. The choke is sized, for example, using the Bernoulli equation, to provide a small pressure drop for the injected gas 208, and a higher pressure drop for liquids 206 above a designed rate. Due to the higher pressure drop for the liquids 206, the orifice would be functioning as a restriction, lowering the flow rate for the liquids 206. The upstream choke would be subjected to any erosive effects encountered in the unloading process, while the critical downstream stem and seat and the reverse-flow check flow valve would be protected.

Figure 3A:
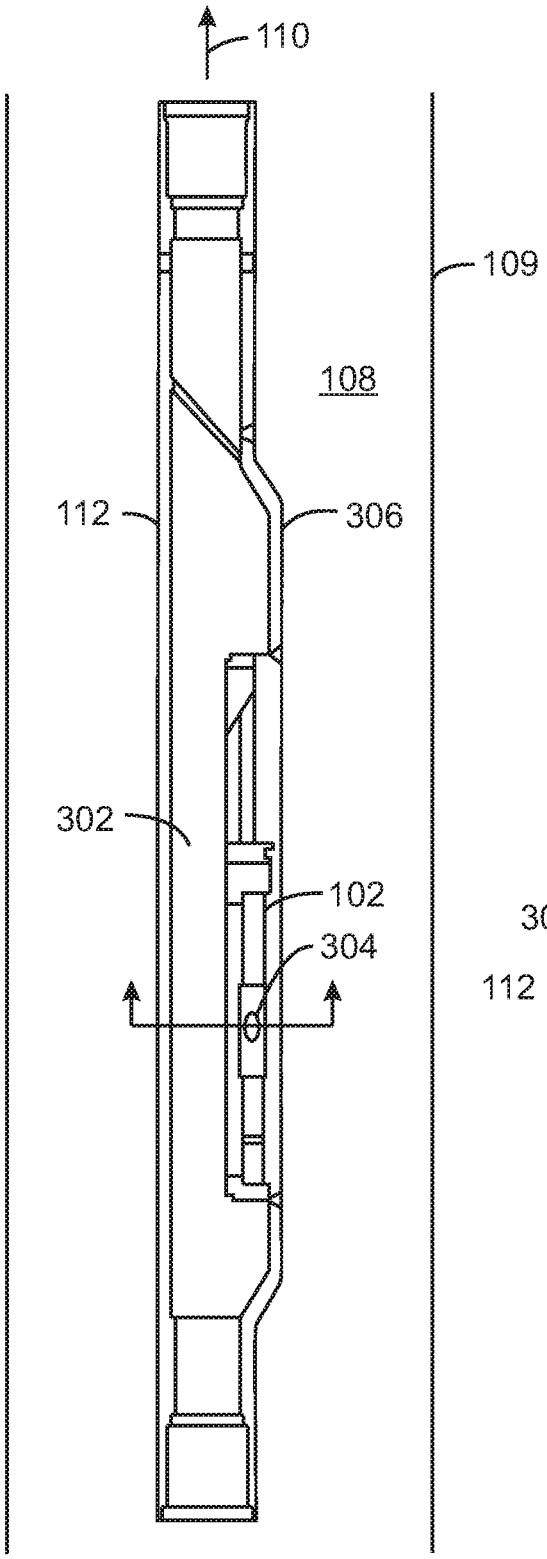
FIG. 3(A) is a cutaway view of production tubing having a GLV that fluidically couples an annulus to the interior of the production tubing, in accordance with examples.

FIG. 3(A) is a cutaway view of production tubing 112 having a GLV 102 that fluidically couples the outer annulus 108 to the interior 302 of the production tubing 112, in accordance with examples. Like numbered items are as described with respect to FIG. 1.

As shown in the cutaway view, a restrictive orifice, for example, as described with respect to FIG. 2, is installed between the GLV 102 and the outer annulus 108. In some examples, the restrictive orifice, which is termed an unloading protection orifice 304 herein, is located only in an unloading valve in the shallowest position. The topmost GLV 102, or unloading valve, is most likely to be damaged during the unloading process as it often passes the largest volume of unloading liquid. However, a deeper GLV 102 may be protected with an unloading protection orifice 304 as required. In some examples, the topmost GLV and the GLVs in near horizontal sections each include the unloading protection orifices 304. In other examples, all of the GLVs, including the operating valve, include the unloading protection orifices 304.

It may be noted that the inner diameter of the unloading protection orifices 304 used in the operating valve, for example, the deepest GLV 102, may be larger than the inner diameter of the unloading protection orifices 304 used in any one of other GLVs 102. For example, the inner diameter of the unloading protection orifices 304 used in a GLV 102 that is used for unloading may be around 14/64 in. while the inner diameter of the unloading protection orifice for the operating valve is 16/64 in. In other examples, the inner diameter of the seat of the operating valve is the same as the unloading valves.

The unloading protection orifice 304 may be formed using a different metallurgical composition from other parts of the GLV 102. For example, the unloading protection orifice 304 may be formed from a stronger material, e.g., a harder metal, than the stems and seats of the GLV 102. In various examples, the GLV 102, including the stems and seats, is manufactured from stainless steel or MONEL®, and the unloading protection orifice 304 is made from tungsten carbide steel. In other examples, the GLV 102 is manufactured from stainless steel, and both the stems and seats and the unloading protection orifice are made from tungsten carbide steel. Other metallurgical compositions may be used in the valves and orifices, including, for example, bimetallic strips protecting high wear zones. In some examples, the GLV 102 is manufactured from stainless steel, the stems and seats are manufactured from tungsten carbide steel, and the unloading protection orifice 304 is manufactured from a weaker material, e.g., a softer metal, such as MONEL®. This allows the unloading protection orifice 304 to act as a sacrificial device during the unloading process, wearing away while protecting the stem and seat of the valve.

The unloading protection orifice 304 may be constructed as part of the GLV 102 or may be installed separately after manufacturing of the GLV 102. For example, the opening on the GLV 102 may be threaded to accept an unloading protection orifice 304. This allows the selection of an unloading protection orifice 304 depending on the intended use of the GLV 102. For example, a GLV 102 that is intended to be an operating valve may have a larger unloading protection orifice 304 selected than a GLV 102 that is intended to be an unloading valve.

In the example shown in FIG. 3(A), the GLV 102 is installed in a side pocket mandrel 306 that is constructed as a section, or joint, of production tubing that has an oblong expansion. This is shown further with respect to FIG. 3(B).

Figure 3B:
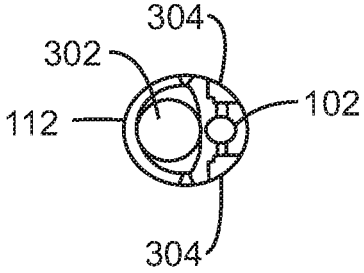
FIG. 3(B) is a cross-sectional view of the GLV through the unloading protection orifice, in accordance with examples.

FIG. 3(B) is a cross-sectional view of the GLV 102 through the unloading protection orifice 304, in accordance with examples. In this example, to unloading protection orifices 304 are in fluid communication with the GLV 102. The total surface area of the two unloading protection orifices 304 is added together to determine the size of each of the unloading protection orifices 304 selected. For example, the total surface area may be equivalent to a 14/64 in inner diameter for an unloading valve, or about 16/64 in. inner diameter for an operating valve. Any number of other designs may be used, as described with respect to FIGS. 4 to 10.

Figure 4:
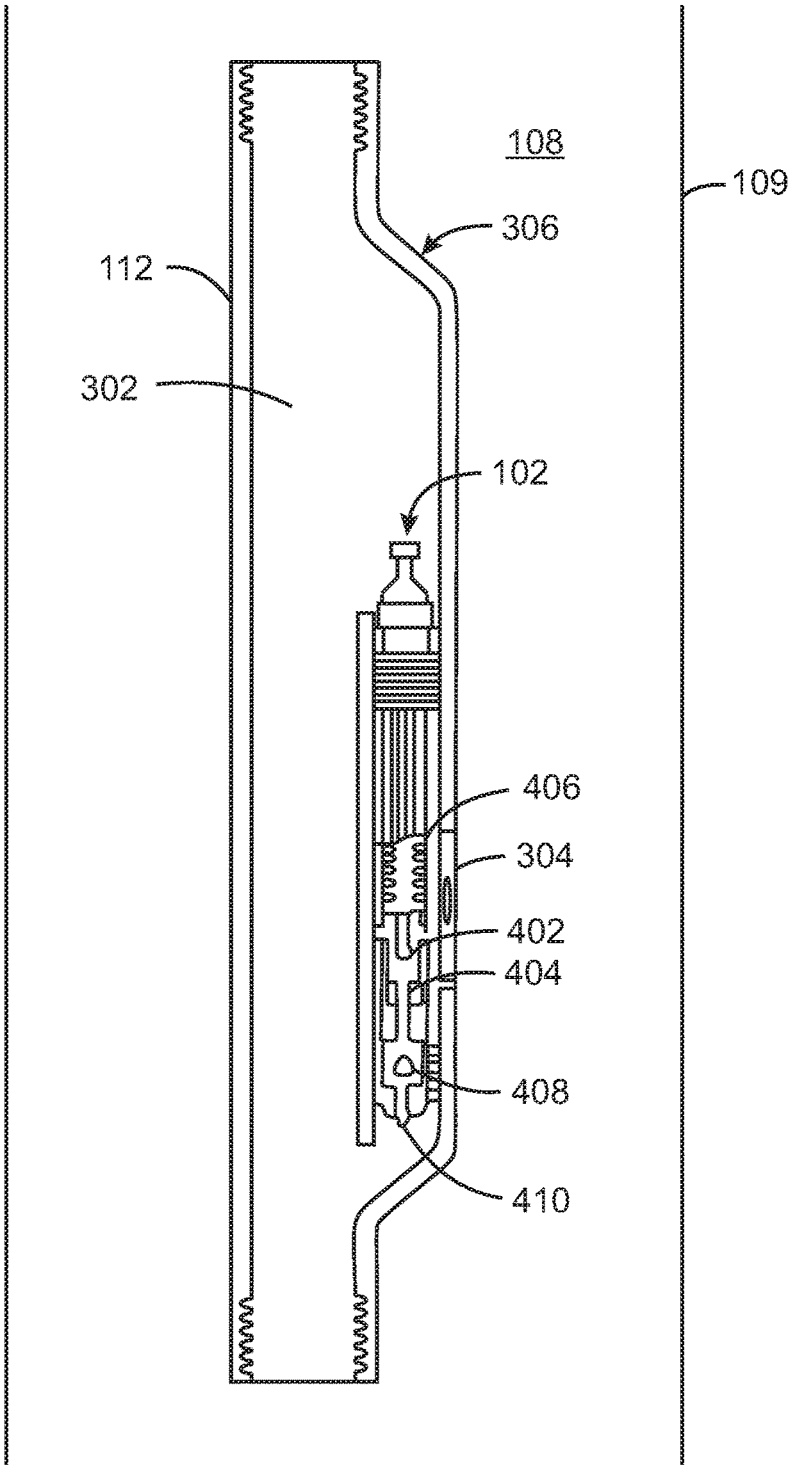
FIG. 4 is a side cross-sectional view of a GLV in a side pocket mandrel with an unloading protection orifice between the GLV and an annulus, in accordance with examples.

FIG. 4 is a side cross-sectional view 400 of a GLV 102 in a side pocket mandrel 306 with an unloading protection orifice 304 between the GLV 102 and an annulus, in accordance with examples. Like numbered items are as described with respect to FIGS. 1 and 3. The total surface area of the unloading protection orifices 304 is selected to protect the stem 402 and seat 404 of the GLV 102 from erosion as liquid flows through the GLV 102. Accordingly, the surface area of a single unloading protection orifice 304 may be selected to be larger than the surface area of the seat 404 of the GLV 102. If multiple unloading protection orifices 304 are used, the sum of the surface area of the unloading protection orifices 304 may be selected to be larger than the surface area of the seat 404 of the GLV 102.

Also visible in this example, are other components of the GLV 102, including a bellows 406, backflow control valve 408, and internal nozzle 410. The bellows 406, shown in a partial cutaway view, provides the operational force that determines the pressure at which the GLV 102 will open and close. Depending on the installation depth of the GLV 102 in the well and the supply gas pressure, among other factors, the pressure, or expected backpressure, may be in a range of between about 1000 psig and about 5000 psig. In some examples, the pressure of the topmost GLV is set to about 1200 psig and the pressure of the operating valve, or lowest GLV, is set to about 1000 psig.

The backflow control valve 408 is configured to prevent flow of produced fluids from the interior 302 of the production tubing 112, through the internal nozzle 410, to the outer annulus 108. Accordingly, the unloading protection orifice 304 also protects the backflow control valve 408 from damage during unloading.

The internal nozzle 410 allows fluids to flow through the GLV 102 between the interior 302 of the production tubing 112 and the outer annulus 108. For example, gas or liquid flows from the outer annulus 108 through the unloading protection orifice 304 into the GLV 102, and is released into the interior 302 of the production tubing 112 through the internal nozzle 410. The internal nozzle 410 is not limited to the design shown in FIG. 4. In some examples, the design discussed with respect to FIG. 5 is used instead.

In the examples described with respect to FIGS. 1 to 4, the GLV 102 is located in a side pocket mandrel 306. In these examples, the GLV 102 is configured to be retrieved for servicing by a tool, such as a wireline tool. The use of the side pocket mandrel 306 simplifies this operation. However, the techniques described herein may be used in any number of other mounting points for GLVs 102, for example, as described with respect to FIG. 5.

Figure 5:
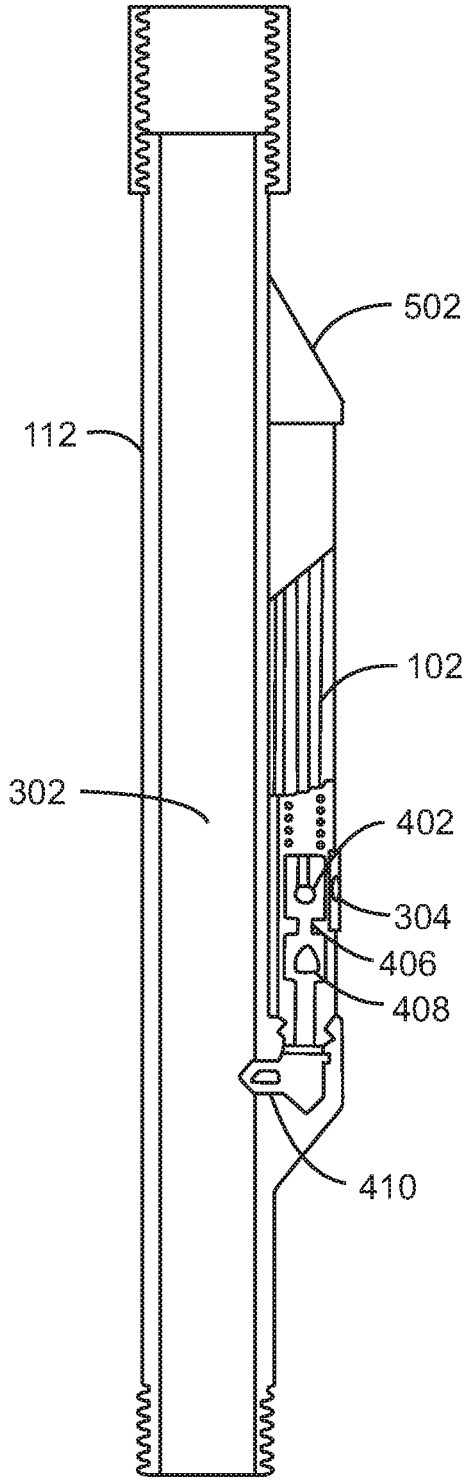
FIG. 5 is a side cross-sectional view of a GLV in a conventional mandrel with an unloading protection orifice between the GLV and an annulus, in accordance with examples.

FIG. 5 is a side cross-sectional view 500 of a GLV 102 in a conventional mandrel 502 with an unloading protection orifice 304 between the GLV 102 and an annulus, in accordance with examples. Like numbered items are as described with respect to FIGS. 1, 3, and 4. As for the GLV 102 described with respect to FIG. 4, the GLV 102 in the conventional mandrel 502, or side pocket mandrel, has an internal nozzle 410 fluidically coupling the GLV 102 to the interior 302 of the production tubing 112. In some examples, the internal nozzle 410 is the only opening between the conventional mandrel 502 and the production tubing 112. In this example, the GLV 102 is not accessible from the production tubing 112 after the production tubing 112 is placed within the well.

Figure 6A:
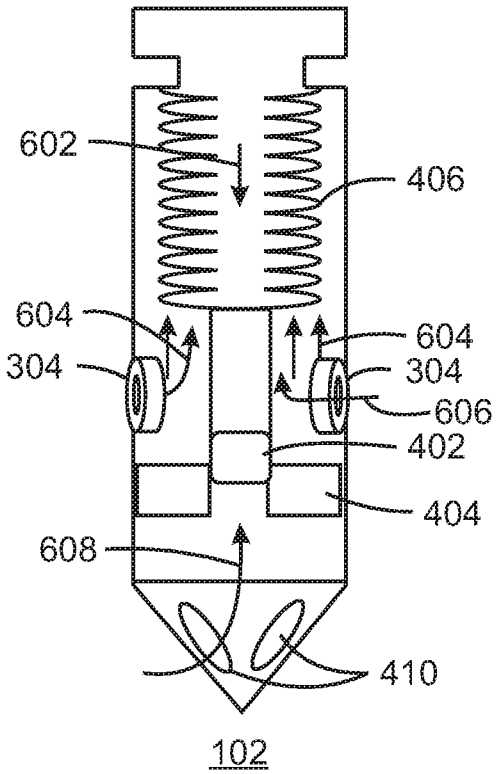
FIGS. 6(A) and 6(B) are cross-sectional schematic views of the operation of a GLV, in accordance with examples.
Figure 6B:
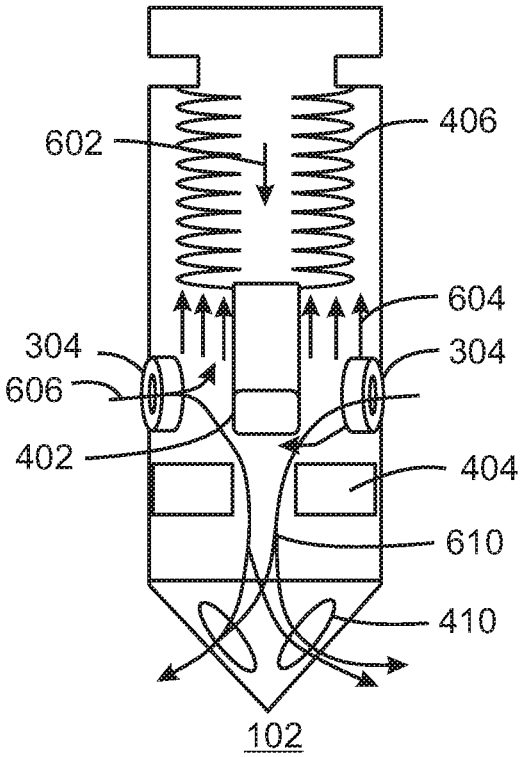

FIGS. 6(A) and 6(B) are cross-sectional schematic views of the operation of a GLV 102, in accordance with examples. Like numbered items are as described with respect to previous figures. As shown in FIG. 6(A), the charge pressure 602 in the bellows 406 is higher than the total pressure 604, measured as the sum of the annulus pressure 606 and the interior pressure 608 in the production tubing. As a result, the GLV 102 is closed, with the stem 402 in place on top of the seat 404. In the following figures, only the total pressure 604 is shown.

As the total pressure 604 increases in the annulus and becomes higher than the charge pressure 602 in the bellows 406 the stem 402 is pushed back from the seat 404 and the GLV 102 opens, as shown in FIG. 6(B). This allows fluids 610, such as gas and liquid, to flow into the GLV 102 through the unloading protection orifice 304, and into the production tubing through the internal nozzle 410.

Figure 7:
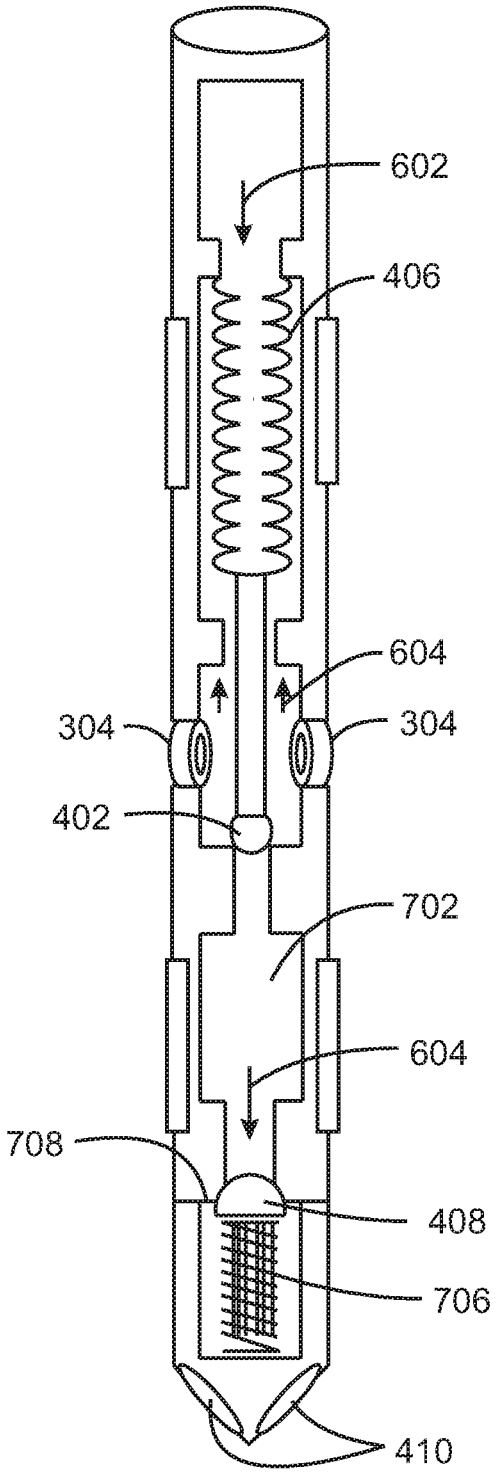
FIG. 7 is a cross-sectional view of a GLV having two unloading protection orifices in accordance with examples.

FIG. 7 is a cross-sectional view of a GLV 102 having two unloading protection orifices 304 in accordance with examples. Like numbered items are as described with respect to previous figures. In the example shown in the cross-sectional view of FIG. 7, an internal space 702 within the GLV 102 is fluidically coupled to both the stem 402 of the GLV 102 and the backflow control valve 408. If the total pressure 604 is sufficiently high, it will open the GLV 102 by pushing the stem 402 out of the seat 404. Further, the backflow control valve 408 is opened at a lower total pressure 604 then the stem 402 of the GLV 102. When both the stem 402 and the backflow control valve 408 are opened, fluids flow from the unloading protection orifices 304 through the GLV 102.

Further, if fluids flow into the internal nozzles 410, for example, due to higher pressure in the production tubing, the flow around the backflow control valve 408 will close the backflow control valve 408, preventing fluids from flowing from the production tubing into the annulus. In this example, the set point of the backflow control valve 408 is determined by the selection of a spring 706 that holds the stem of the backflow control valve 408 against the seat 708. It can be noted that the illustration in FIG. 7 is functional, and that different configurations of flow paths may be used.

Figure 8:
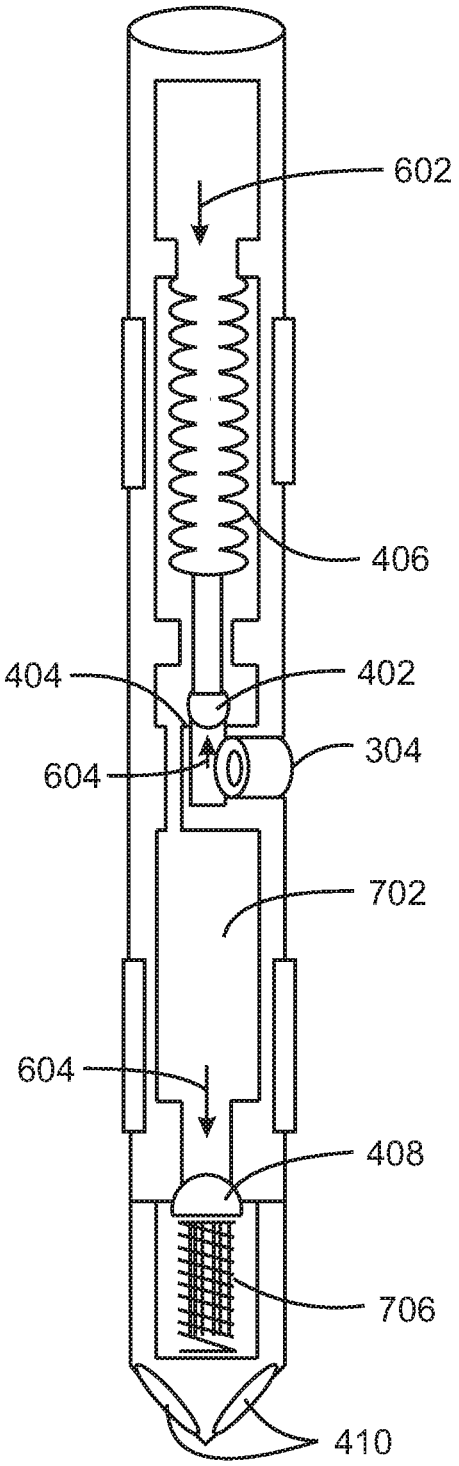
FIG. 8 is a cross-sectional view of a GLV having a single unloading protection orifice, in accordance with examples.

FIG. 8 is a cross-sectional view 800 of a GLV 102 having a single unloading protection orifice 304, in accordance with examples. Like numbered items are as described with respect to the previous figures. The GLV 102 is not limited to having two unloading protection orifices 304, but may have a single unloading protection orifice 304 as shown in FIG. 8. Although, as described herein, the surface area of the unloading protection orifice 304 may be larger than the surface area of each of the two unloading protection orifices 304 described with respect to FIG. 7, the functionality and operation is the same. When the total pressure 604 is greater than the charge pressure 602, the stem 402 of the GLV 102 is lifted from the seat 404, allowing material to flow between the unloading protection orifice 304 and the backflow protection valve 408, which also opens to allow fluid to flow into the production tubing through the internal nozzles 410.

For example, when the gas pressure in the annulus outside of the GLV 102 is sufficiently high, gas will flow through the unloading protection orifice 304, through the backflow control valve 408, then through the internal nozzles 410 into the production tubing.

Figure 9:
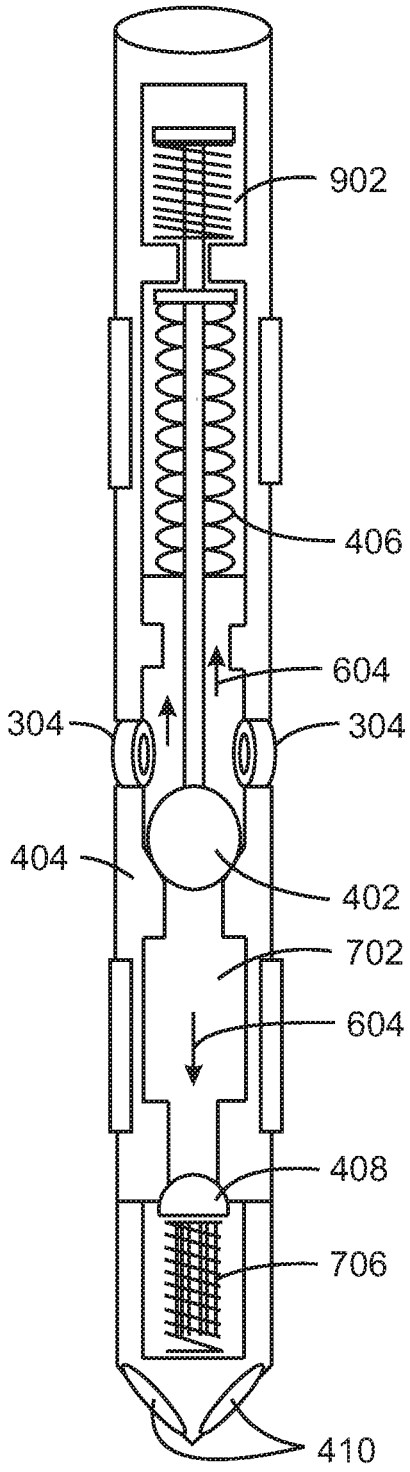
FIG. 9 is a cross-sectional view of another design for a GLV having two unloading protection orifices, in accordance with examples.

FIG. 9 is a cross-sectional view of another design for a GLV 102 having two unloading protection orifices 304, in accordance with examples. Like numbered items are as described with respect to previous figures.

The unloading protection orifices 304 do not need to be below the stem 402 of the GLV 102. As shown in FIG. 9, the unloading protection orifices 304 may be located above the stem 402 of the GLV 102. In this example, the stem 402 of the GLV 102 is operated by a spring 902 rather than a bellows, e.g., is a spring-loaded valve stem, although other examples may include the bellows. When the total pressure 604 is greater than the elongation force for the spring 902, the stem 402 retracts from the seat 404 allowing material to flow from the unloading protection orifices 304 to the internal nozzles 410, for example, opening the backflow control valve 408 to allow flow. In addition to the unloading protection orifices 304, this design may further reduce damage to the stem 402 and seat 404 from liquid flow, as the larger ball size of the stem 402 creates a larger surface area for the liquid to flow, lowering the total flow rate around the stem 402.

Figure 10:
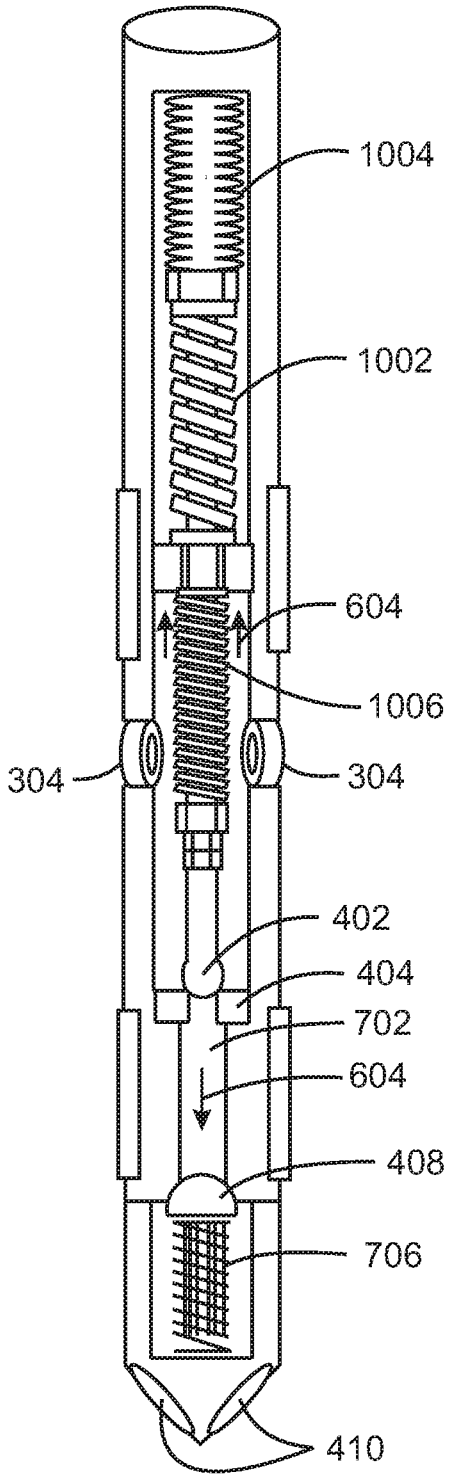
FIG. 10 is a cross-sectional view of another spring-loaded GLV having two unloading protection orifices, in accordance with examples.

FIG. 10 is a cross-sectional view of another spring-loaded GLV 102 having two unloading protection orifices 304, in accordance with examples. Like numbered items are as described with respect to previous figures. In this GLV 102, a first spring 1002 is tied to the stem 402, and a spring-loaded bellows 1004. The holding pressure on the stem 402 is provided by the charge pressure 602 in the spring-loaded bellows 1004, the first spring 1002, and a second spring 1006. The charge pressure 602 may be used to incrementally adjust the total pressure 604 at which the GLV 102 opens.

Figure 11:
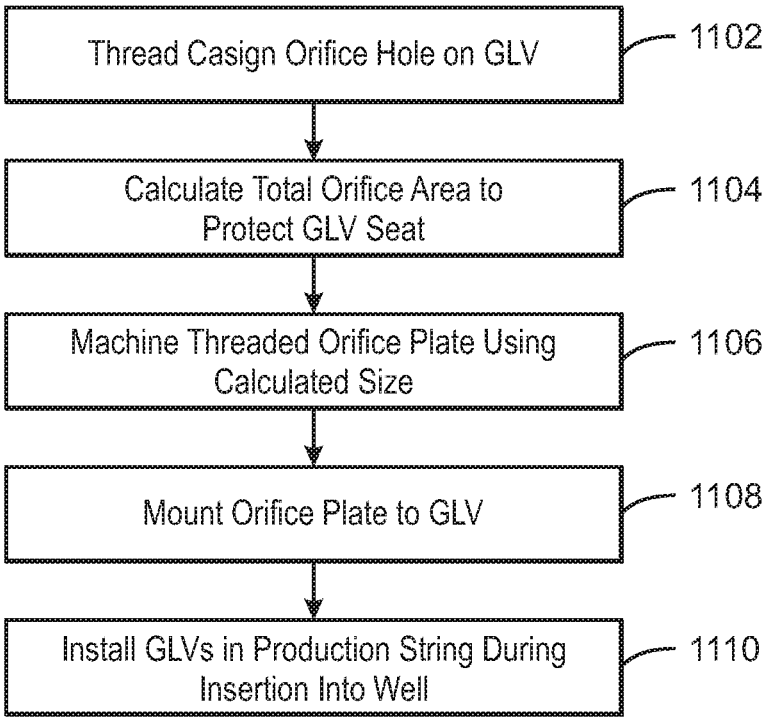
FIG. 11 is a process flow diagram of a method for using unloading protection orifices to protect a GLV from erosion, in accordance with examples.

FIG. 11 is a process flow diagram of a method 1100 for using unloading protection orifices to protect a GLV from erosion, in accordance with examples. The method begins at 1102, with the threading of an external orifice opening or aperture on the GLV. In some examples, the unloading protection orifice is spot welded into the external orifice opening.

At block 1104, the total orifice area for the unloading protection orifices to be used in the GLV is calculated. As described herein, the calculation may be based on the location of the GLV in the well, as well as the function of the GLV, for example, unloading of liquid from the well during completion versus an operating GLV.

At block 1106, an opening (aperture) in an orifice plate is machined to the design size for the unloading protection orifice, based on the calculated size. The opening may be coated with a more erosion resistant metal to form a bimetallic orifice plate. If the external orifice opening on the GLV has been threaded, mating threads may be formed on the orifice plate.

At block 1108, the orifice plate may be mounted to the GLV. In various examples, this may be performed by threading the orifice plate into the matching external orifice opening on the GLV. In other examples, this may be performed by welding the orifice plate into the external orifice opening on the GLV.

At block 1110, the GLVs are installed into the production string during insertion of the production string into the well. This may be performed, for example, by replacing pipe joints at the appropriate points in the production string with a joint that includes the GLV.

While the present techniques may be susceptible to various modifications and alternative forms, the example examples discussed above have been shown only by way of example. However, it should again be understood that the present techniques are not intended to be limited to the particular examples disclosed herein. Indeed, the present techniques include all alternatives, modifications, and equivalents falling within the true spirit and scope of the appended claims.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A well completion comprising a gas lift valve, wherein the gas lift valve comprises an unloading protection orifice, and wherein the unloading protection orifice comprises a different open area than a valve seat in the gas lift valve, wherein the unloading protection orifice comprises a harder metal than a seat and stem of the gas lift valve.

2. The well completion of claim 1, wherein the gas lift valve is a topmost valve in the well completion.

3. The well completion of any of claim 1, wherein the gas lift valve is mounted in a side pocket mandrel.

4. The well completion of any of claim 1, wherein the gas lift valve comprises a bellows, wherein pressure in the bellows is selected based, at least in part, on an expected backpressure at an installation depth in the well.

5. The well completion of any of claim 1, wherein the gas lift valve comprises a threaded fitting configured to mate to the unloading protection orifice.

6. The well completion of any of claim 1, comprising a mandrel that comprises a threaded fitting configured to mate to the unloading protection orifice.

7. The well completion of any of claim 1, wherein the unloading protection orifice comprises a different metallurgical composition than a seat and stem of the gas lift valve.

8. The well completion of any of claim 1, wherein a surface area of an opening of the unloading protection orifice is based, at least in part, on a depth of the gas lift valve.

9. A gas lift valve, comprising an unloading protection orifice, and wherein the unloading protection orifice comprises an open area that is different than a valve seat in the gas lift valve, wherein the unloading protection orifice comprises a harder metal than a seat and stem of the gas lift valve.

10. The gas lift valve of claim 9, wherein the gas lift valve is mounted in a side pocket mandrel.

11. The gas lift valve of claim 9, comprising a bellows, wherein charge pressure in the bellows is selected based, at least in part, on an expected backpressure at an installation depth in a well.

12. The gas lift valve of claim 9, comprising a threaded fitting configured to mate to the unloading protection orifice.

13. The gas lift valve of claim 9, comprising a second unloading protection orifice.

14. The gas lift valve of claim 9, wherein the unloading protection orifice comprises a different metallurgical composition than a seat and stem of the gas lift valve.

15. The gas lift valve of claim 9, comprising a backflow control valve.

16. A method for protecting a gas lift valve (GLV) from erosion, comprising:

calculating an area for an unloading protection orifice, wherein the area is based, at least in part, on a depth of the in a well;

machining the unloading protection orifice into an orifice plate using the calculated area;

mounting the unloading protection orifice in an opening between the GLV and an annulus of the well; and installing the GLV into a production tubing string as the production tubing string is installed in the well.

17. The method of claim 16, comprising:

threading the opening between the GLV and the annulus of the well;

forming mating threads on the orifice plate; and mounting the unloading protection orifice in the opening using the mating threads.

18. The method of claim 16, comprising installing the GLV in the shallowest position in the well.

19. The method of claim 16, comprising selecting a larger unloading protection orifice for the deepest GLV in the well.

* * * * *